US011746541B2

(12) United States Patent
Igo

(10) Patent No.: US 11,746,541 B2
(45) Date of Patent: Sep. 5, 2023

(54) HIGH COMPRESSIVE STRENGTH SOUND ATTENUATION

(71) Applicant: Formulated Materials LLC, Oklahoma City, OK (US)

(72) Inventor: John Igo, Edmond, OK (US)

(73) Assignee: Formulated Materials LLC, Oklahoma City, OK (US)

( * ) Notice: Subject to any disclaimer, the term of this patent is extended or adjusted under 35 U.S.C. 154(b) by 43 days.

(21) Appl. No.: 16/835,692

(22) Filed: Mar. 31, 2020

(65) Prior Publication Data

US 2020/0308850 A1 Oct. 1, 2020

Related U.S. Application Data

(60) Provisional application No. 62/827,610, filed on Apr. 1, 2019.

(51) Int. Cl.
*E04F 15/20* (2006.01)

(52) U.S. Cl.
CPC ..... *E04F 15/20* (2013.01); *E04F 2290/041* (2013.01)

(58) Field of Classification Search
CPC ..... E04F 15/123; E04F 15/185; E04F 15/20; E04F 15/203; E04F 2290/041; E04F 2290/043
See application file for complete search history.

(56) References Cited

U.S. PATENT DOCUMENTS 2,956,785 A * 10/1960 Richl ..... F24D 5/10 165/56
3,597,891 A * 8/1971 Martin ..... E04C 2/3405 52/145
4,640,854 A * 2/1987 Radtke ..... E04F 15/182 428/179
4,956,951 A * 9/1990 Kannankeril ..... E02D 31/02 405/36
5,052,161 A * 10/1991 Whitacre ..... E04F 15/186 52/390

(Continued)

FOREIGN PATENT DOCUMENTS

KR 2020100002963 3/2010
KR 101181696 9/2012
KR 20140134051 A * 11/2014

OTHER PUBLICATIONS

Machine Translation of KR 10-1181696, Espacenet, accessed Sep. 29, 2022 (Year: 2022).*

(Continued)

*Primary Examiner* — James M Ference
(74) *Attorney, Agent, or Firm* — McAfee & Taft

(57) ABSTRACT

The present disclosure describes a sound attenuating flooring system. The sound attenuating flooring system has a subfloor, a sound attenuating material overlaying and contacting only a portion of the subfloor, and an overlayment. The sound attenuating material has a first surface and second surface. The first surface is defined by a plurality of outwardly projecting hollow protrusions. The second surface is defined by a plurality of open recesses corresponding to the plurality of outwardly projecting hollow protrusions. The overlayment overlays the second surface of the sound attenuating material.

26 Claims, 9 Drawing Sheets

(56) References Cited

U.S. PATENT DOCUMENTS 5,082,712 A * 1/1992 Starp ..... E04F 15/10 428/174
5,619,832 A * 4/1997 Myrvold ..... E02D 31/02 52/403.1
6,094,878 A * 8/2000 Schluter ..... E04D 11/00 52/323
6,213,252 B1 * 4/2001 Ducharme ..... E04F 15/20 181/294
6,939,599 B2 * 9/2005 Clark ..... B32B 3/30 428/178
7,021,017 B2 * 4/2006 Herron ..... E04C 2/32 428/116
7,536,835 B2 * 5/2009 Schluter ..... E04F 15/18 52/302.1
7,585,556 B2 * 9/2009 Julton ..... E04F 15/18 52/302.1
8,146,310 B2 * 4/2012 Keene ..... E04F 15/182 52/403.1
8,528,286 B2 * 9/2013 Keene ..... E04B 1/84 52/403.1
8,695,300 B2 * 4/2014 Hartl ..... E04F 15/186 52/302.1
9,016,018 B2 * 4/2015 Boyle ..... E04F 15/087 52/749.11
9,157,231 B2 * 10/2015 Wingfield ..... E04F 15/203
9,328,520 B1 * 5/2016 Kriser ..... E04F 15/082
9,625,163 B2 * 4/2017 Larson ..... E04B 5/48
2003/0154676 A1 * 8/2003 Schwartz ..... E04F 15/02138 52/592.1
2005/0158517 A1 * 7/2005 Rives ..... E04F 15/18 428/167
2005/0229520 A1 * 10/2005 Julton ..... E04F 13/04 52/177
2006/0230699 A1 * 10/2006 Keene ..... E04F 15/182 52/480
2007/0056237 A1 * 3/2007 Kang ..... E04F 15/203 52/403.1
2008/0236097 A1 * 10/2008 Tinianov ..... E04F 15/20 52/787.11
2008/0295441 A1 * 12/2008 Carolan ..... E04C 2/322 52/633
2009/0230113 A1 * 9/2009 Batori ..... E04F 15/18 219/213
2010/0282539 A1 * 11/2010 Cais ..... E04F 15/20 181/290
2010/0319286 A1 * 12/2010 Becker ..... E04F 15/182 52/390
2013/0011609 A1 * 1/2013 Comitale ..... B32B 7/12 428/141
2014/0069039 A1 * 3/2014 Schluter ..... E04F 15/185 52/390
2017/0292278 A1 * 10/2017 Gutjahr ..... E04F 15/183
2018/0073254 A1 * 3/2018 Hainbach ..... E04F 15/02177
2018/0202150 A1 * 7/2018 Downey ..... B32B 27/365
2018/0223543 A1 * 8/2018 Faotto ..... F24D 13/024
2020/0308850 A1 * 10/2020 Igo ..... E04F 15/185

OTHER PUBLICATIONS

"ThermalDry Insulated Floor Decking", Basement Systems, Oct. 14, 2017, accessed via Web Archive, https://web.archive.org/web/20171014021853/https://www.basementsystems.com/basement-finishing/basement-flooring/insulated-subfloor.html (Year: 2017).*
"Why All-Foam Basement Subfloors Make Sense", Dricore, accessed Sep. 29, 2022 (Year: 2022).*
"subfloor" definition, Merriam-Webster Dictionary, accessed Sep. 29, 2022, https://www.merriam-webster.com/dictionary/subfloor (Year: 2022).*
Formulated Materials, Treadstone M2 Sound Attenuating Mat, Technical Data Sheet, Mar. 27, 2019, pp. 1-3.
Formulated Materials, Treadstone R2 Sound Attenuating Mat, Technical Data Sheet, Apr. 3, 2019, pp. 1-3.
Formulated Materials, Treadstone R1 Sound Attenuating Mat, Technical Data Sheet, Apr. 3, 2019, pp. 1-3.
Formulated Materials, Treadstone M3 Sound Attenuating Mat, Technical Data Sheet, Mar. 27, 2019, pp. 1-3.
Canadian Office Action received in corresponding Canadian Application No. 3,077,825 dated Apr. 22, 2021, pp. 1-6.

* cited by examiner

SOUND ATTENUATING MAT

| Displacement (% of total thickness) | Sound Attenuating Mat 30 Compressive Strength | Cylindrical Studded Membrane of Polyolefins laminated to Polypropylene Fabric Compressive Strength | Diamond Studded Polypropylene laminated to Polypropylene Fabric Compressive Strength | 3 - Dimensional Mesh of Polypropylene on a Polypropylene Barrier Fabric Compressive Strength | 3 - Dimensional Mesh of Polypropylene on a Polypropylene Barrier Fabric Compressive Strength |
|---|---|---|---|---|---|
| % | pounds / $ft^2$ | pounds / $ft^2$ | pounds / $ft^2$ | pounds / $ft^2$ | pounds / $ft^2$ |
| 5% | 2558 | 164.7 | 235 | 222 | 153 |
| 10% | 6924 | 491.8 | 811 | 417 | 279 |
| 20% | 12722 | 2720 | 3920 | 785 | 721 |
| 30% | 15346 | 6963 | 6748 | 1181 | 1430 |
| 40% | 15525 | 9048 | 9038 | 1603 | 2202 |
| 50% | 15099 | 9727 | 11431 | 2161 | 3038 |

FIG. 7

SOUND ATTENUATING MAT WITH GYPSUM LAYER OVERLAYMENT

| Displacement (% of total thickness) | Sound Attenuating Mat 30 Compressive Strength | Cylindrical Studded Membrane of Polyolefins laminated to Polypropylene Fabric Compressive Strength | Diamond Studded Polypropylene laminated to Polypropylene Fabric Compressive Strength | 3 - Dimensional Mesh of Polypropylene on a Polypropylene Barrier Fabric Compressive Strength | 3 - Dimensional Mesh of Polypropylene on a Polypropylene Barrier Fabric Compressive Strength |
|---|---|---|---|---|---|
| % | pounds / $ft^2$ | pounds / $ft^2$ | pounds / $ft^2$ | pounds / $ft^2$ | pounds / $ft^2$ |
| 5% | 674 | 813 | 315 | 160 | 191 |
| 10% | 5000 | 1503 | 982 | 313 | 396 |
| 20% | 21000 | 3583 | 2993.6 | 688 | 827 |
| 30% | - | 6055 | 5306 | 1051 | 1511.6 |
| 40% | - | - | 7952 | 1536 | 2423.9 |
| 50% | - | - | 10019 | 2217.8 | 3629.5 |

FIG. 8

| Type of Sound Attenuating Material | Finished Floor Covering | Impact Isolation Class (IIC) Test Results |
|---|---|---|
| None | Vinyl | 44 |
| | Tile | 41 |
| | Wood Laminate | 49 |
| Sound Attenuating Material 30 | Vinyl | 51 |
| | Tile | 51 |
| | Wood Laminate | 55 |
| Sound Attenuating Material 30 with 3mm Fibrous Mat Underneath | Vinyl | 55 |
| | Tile | 56 |
| | Wood Laminate | 56 |

FIG. 3

HIGH COMPRESSIVE STRENGTH SOUND ATTENUATION

CROSS REFERENCE TO RELATED APPLICATION

The present application claims priority to U.S. Provisional Application No. 62/827,610 filed on Apr. 1, 2019, which is incorporated herein by reference.

TECHNICAL FIELD

The present disclosure relates generally to above-ground floor systems, and, more specifically, to an above-ground sound attenuating floor system for reducing the transmission of impact sound while maintaining the flexural strength of the flooring system.

BACKGROUND

In multi-storied buildings, it is desirable to insert a sound attenuating mat into the above-ground floor systems to reduce the transmission of impact sound. Typically, these floor systems utilize three layers: subfloor, overlayment, and flooring, as well as the other structural features and finishes of the building. In this typical application, the overlayment's flexural strength provides the primary protection from an impact failure in the system. However, the insertion of a sound attenuating mat significantly weakens the flexural strength of the flooring system because the sound attenuating mat separates the overlayment from the subfloor, and the matted material has significantly lower compressive and flexural strength, i.e., the matted material has a significantly weaker resistance to deformation under load. In these systems, a thicker application of overlayment is required to maintain the flexural strength of the flooring system to prevent an unacceptable movement causing a floor failure. In flooring systems consisting of a subfloor supported by joists and including the typical sound attenuating mat, the overlayment will normally have a thickness between 0.75" and 1.5". This disclosure describes a sound attenuating flooring system that provides sound attenuation while substantially preserving the flexural strength in the integrity of the flooring system, thereby eliminating the need for thicker applications of overlayment in order to provide the desired flexural strength.

SUMMARY

The present invention provides a sound attenuating flooring system which overcomes the deficiencies described above, and has other advantages.

In one embodiment, a sound attenuating flooring system is provided. The sound attenuating flooring system comprises a subfloor, a sound attenuating material, and an overlayment. The sound attenuating material overlays and contacts a portion of the subfloor. The sound attenuating material includes a first surface and a second surface. The first surface is defined by a plurality of outwardly projecting hollow protrusions. The second surface is defined by a plurality of open recesses corresponding to the plurality of outwardly projecting hollow protrusions. The overlayment overlays the second surface of the sound attenuating material and fills the open recesses.

In some embodiments, the sound attenuating flooring system is characterized by the plurality of outwardly projecting hollow protrusions extending outward by about 0.125 inch to about 0.75 inch. Such embodiments are further characterized by the sound attenuating flooring system supporting between about 10,000 pounds per square foot and about 35,000 pounds per square foot without flexing more than about 0.06 inch.

In some embodiments, the sound attenuating flooring system is characterized by the plurality of outwardly projecting hollow protrusions extending outward by about 0.125 inch to about 0.75 inch. Such embodiments are further characterized by the sound attenuating flooring system supporting between about 10,000 pounds per square foot and about 35,000 pounds per square foot without flexing more than about 0.04 inch.

In additional embodiments, the sound attenuating flooring system further comprises an underlayment located between the subfloor and the sound attenuating material. In other embodiments, the underlayment has a plurality of holes corresponding to the plurality of outwardly projecting hollow protrusions such that the plurality of outwardly projecting hollow protrusions pass through the underlayment and contact the subfloor.

BRIEF DESCRIPTION OF THE DRAWINGS

The drawings included with this application illustrate certain aspects of the embodiments described herein. However, the drawings should not be viewed as exclusive embodiments. The subject matter disclosed is capable of considerable modifications, alterations, combinations, and equivalents in form and function, as will occur to those skilled in the art with the benefit of this disclosure.

FIG. 6 is a cross-sectional side view of a sound attenuating flooring system with an underlayment having a plurality of holes corresponding to the plurality of outwardly projecting hollow protrusions such that the plurality of outwardly projecting hollow protrusions pass through the underlayment and contact the subfloor with the underlayment filling at least a portion of the airgaps.

FIG. 7 is a table reporting test data.

FIG. 8 is a table reporting test data.

FIG. 9 is a table reporting test data.

DETAILED DESCRIPTION

Figure 1:
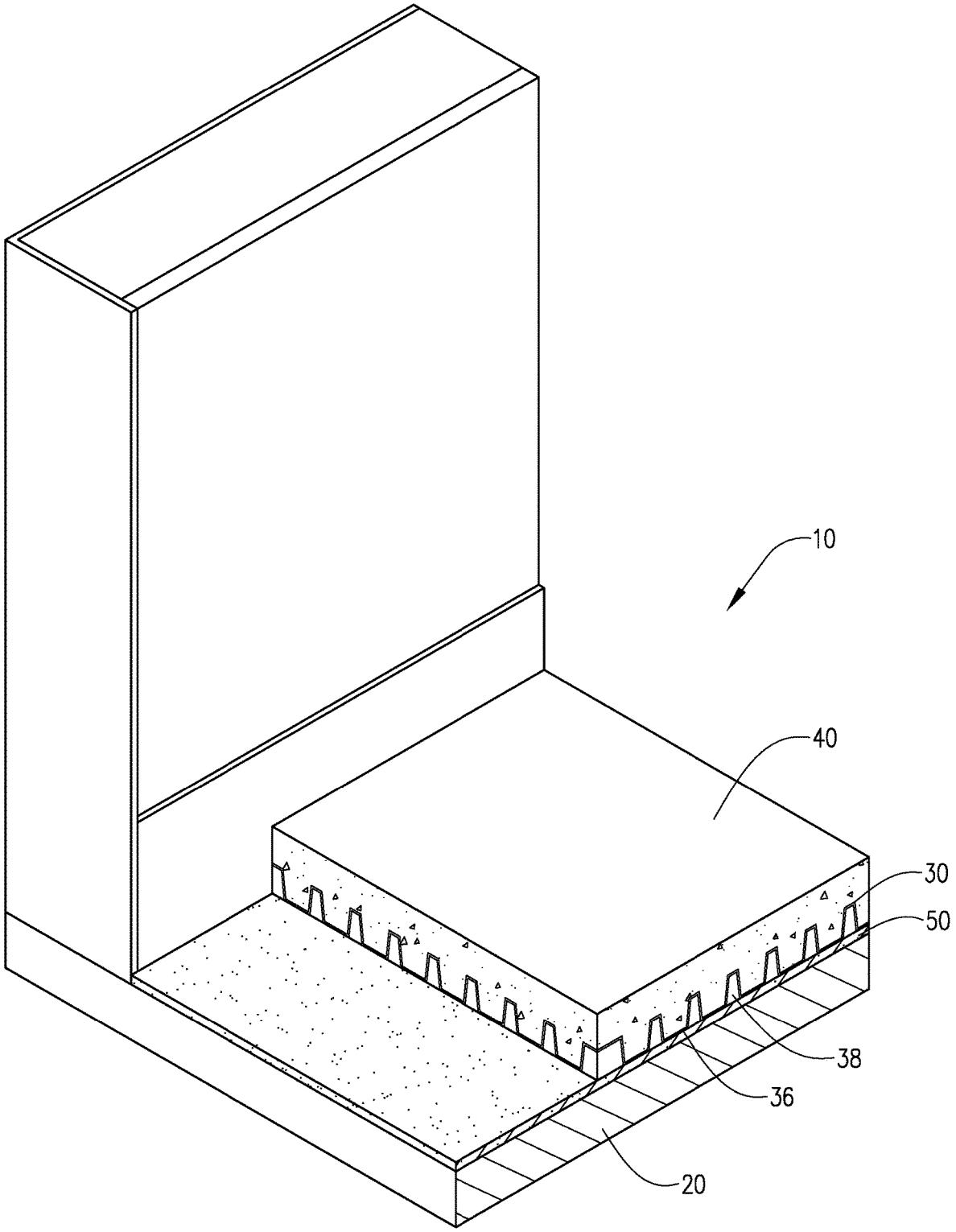
FIG. 1 is a top side perspective view of a sound attenuating flooring system in accordance with one embodiment of the present disclosure.

The present disclosure may be understood more readily by reference to these detailed descriptions. For simplicity and clarity of illustration, where appropriate, reference numerals may be repeated among the different figures to indicate corresponding or analogous elements. In addition, numerous specific details are set forth in order to provide a thorough understanding of the various embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Figure 2:
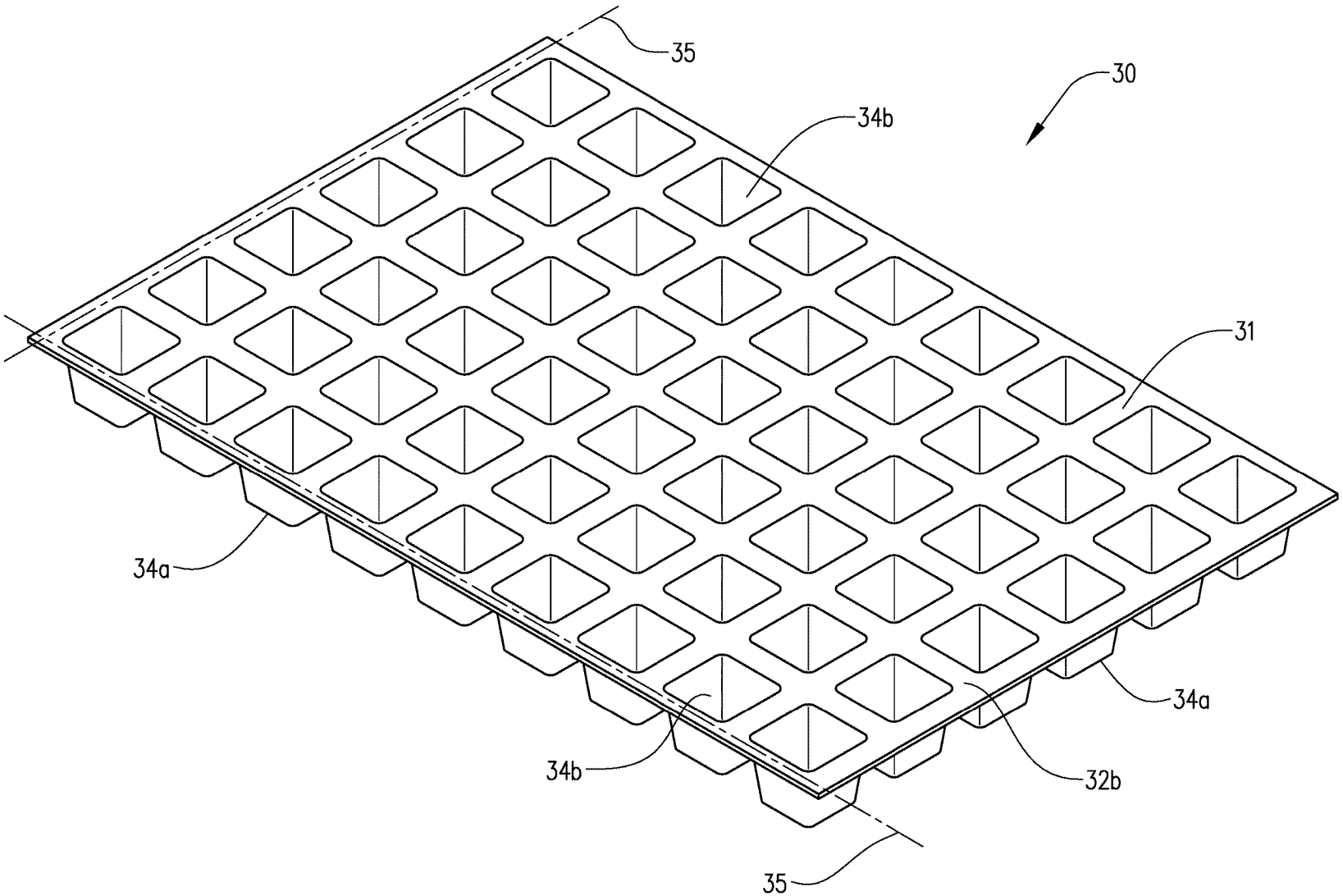
FIG. 2 is a top side perspective view of a sound attenuating material in accordance with one embodiment of the present disclosure.
Figure 3:
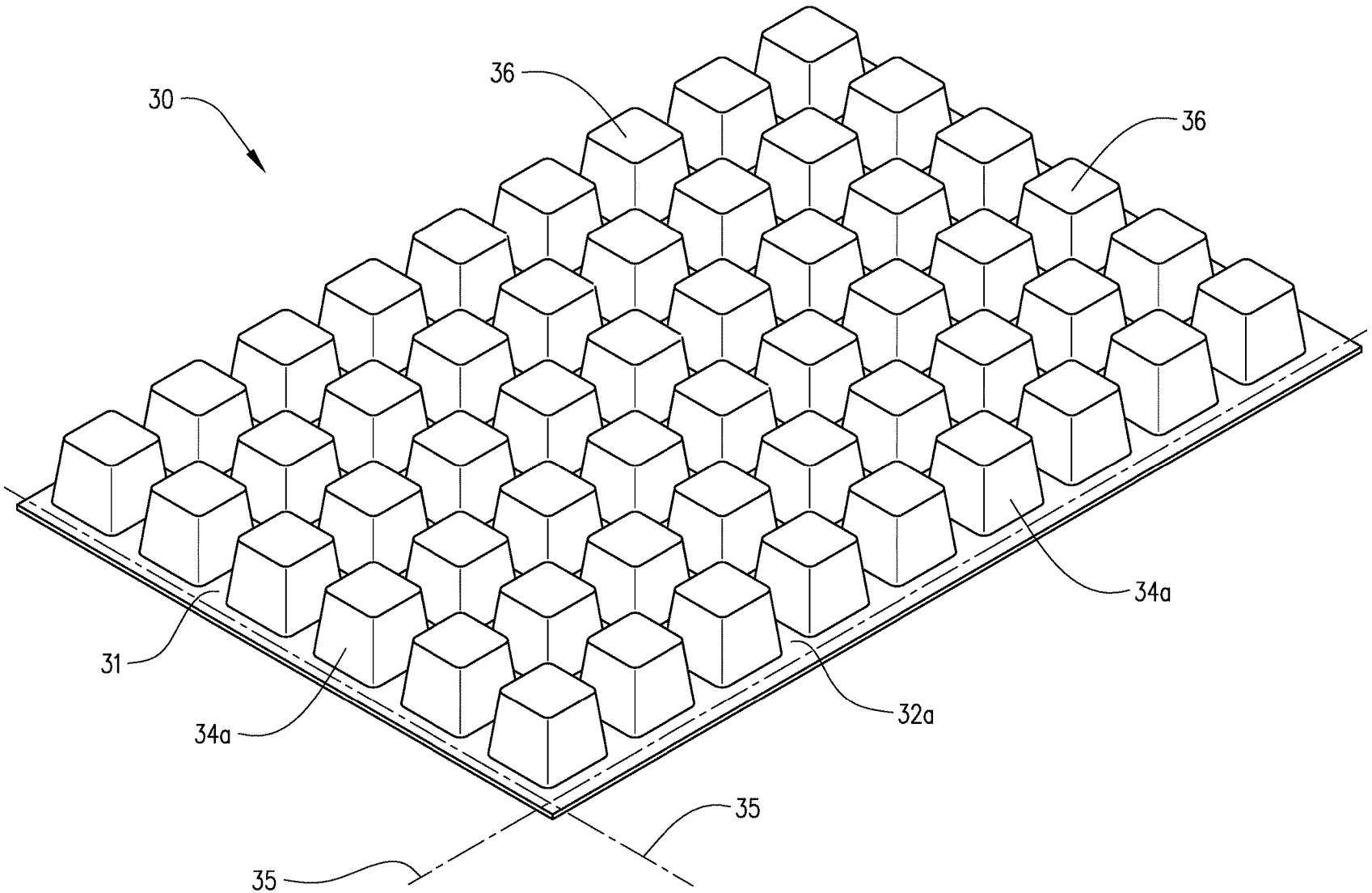
FIG. 3 is a bottom side perspective view of a sound attenuating material in accordance with one embodiment of the present disclosure.
Figure 4:
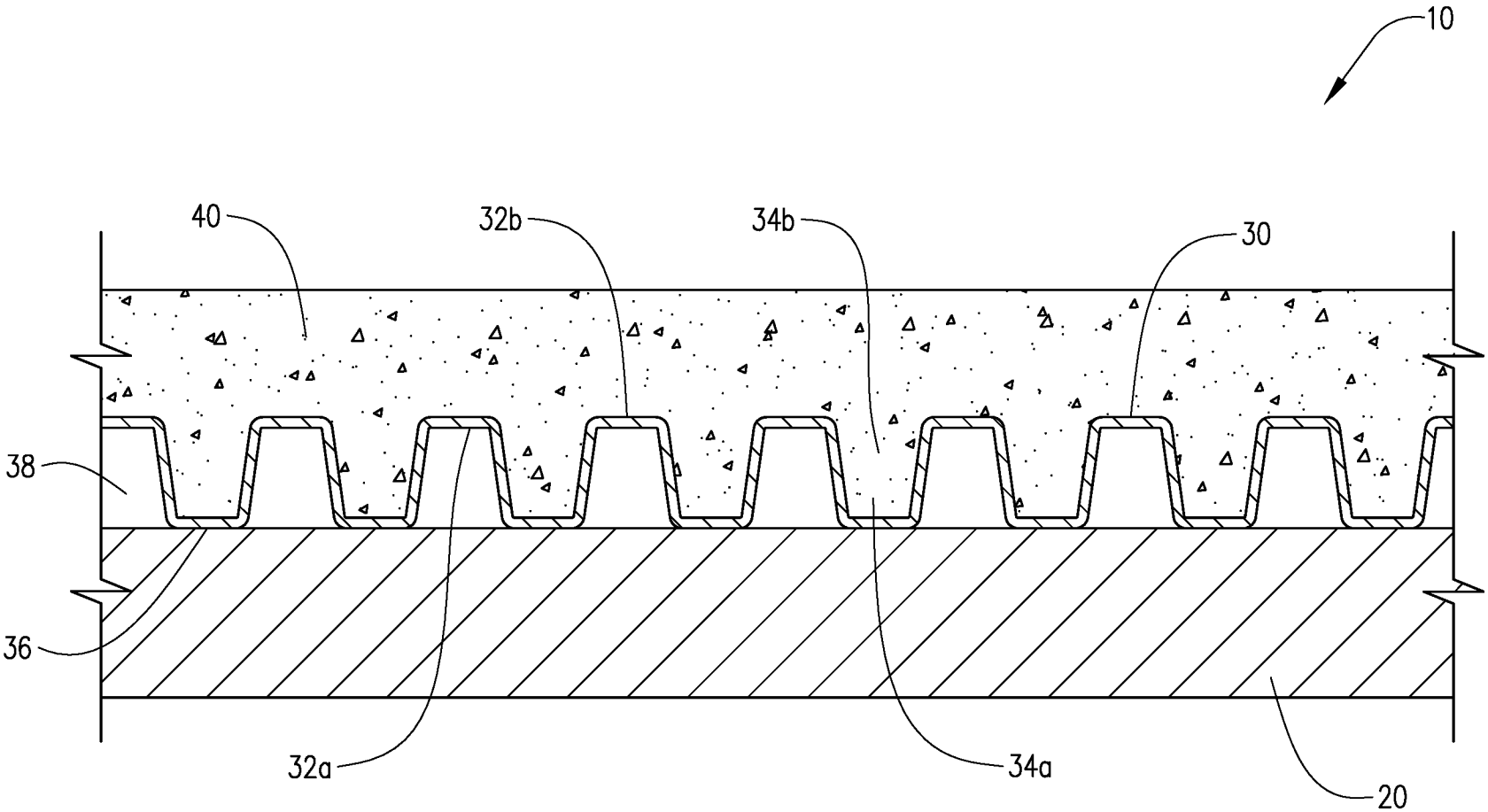
FIG. 4 is a cross-sectional side view of a sound attenuating flooring system without an underlayment in accordance with one embodiment of the present disclosure.

As shown by FIGS. 1-6 generally, the sound attenuating flooring system is illustrated and generally designated by the numeral 10. With reference to FIGS. 1 and 4, the general form of sound attenuating flooring system 10 includes a subfloor 20, a sound attenuating material 30, and an overlayment 40. Subfloor 20 may be manufactured from a number of different materials including plywood, oriented strand board, concrete, or high performance panels. One skilled in the art will understand that the type of subfloor 20 depends on the building configuration and/or the builder's or owner's preference.

With reference to FIGS. 2 and 3, sound attenuating material is illustrated and generally designated by the numeral 30. When installed, sound attenuating material 30 overlays and contacts subfloor 20. Typically, sound attenuating material 30 is prepared from a thermoplastic or thermosetting material. However, one skilled in the art understands that sound attenuating material 30 may be manufactured from a number of different types of durable, and pliable, plastic, rubber, or other polymer material.

Sound attenuating material 30 includes a first surface 32*a* and a second surface 32*b*. First surface 32*a* is defined by a plurality of outwardly projecting hollow protrusions 34*a*. Second surface 32*b* is defined by a plurality of open recesses 34*b* which correspond to hollow protrusions 34*a*. The generally flat surfaces 31 between hollow protrusions 34*a* and open recesses 34*b* define a plane 35.

Typically, hollow protrusions 34*a* extend outwardly from plane 35 about 0.125 inch to about 0.75 inch. More typically, hollow protrusions 34*a* extend outwardly from plane 35 about 0.125 inch to about 0.5 inch. Even more typically, hollow protrusions extend outwardly from plane 35 about 0.125 inch to about 0.375 inch, and, in some embodiments, about 0.125 inch to about 0.1875 inch. For the purposes of this disclosure, the distance hollow protrusion 34*a* extends outward from plane 35 is also referred to as the length of hollow protrusion 34*a*.

Sound attenuating material 30 may have from about 1 and about 50 hollow protrusions 34*a* per square inch. More typically, the density of hollow protrusions 34*a* is from about 4 to about 50 hollow protrusions 34*a* per square inch of sound attenuating material 30. For example, in some embodiments, sound attenuating material 30 has 16 hollow protrusions 34*a* per square inch. In other embodiments, sound attenuating material 30 has 25 protrusions 34*a* per square inch.

Hollow protrusions 34*a* include a tip 36. Upon installation of sound attenuating material 30, tip 36 contacts subfloor 20. Tip 36 may be defined as a pointed surface or a flat, conical, or rounded surface. In some embodiments, tip 36 has a flat surface in the form of a geometric shape. For example, as shown in FIG. 3, tip 36 is square. In other embodiments, tip 36 is a circle, a hexagon, a sphere, or other geometric shape. In some embodiments, tip 36 is coated with a reactive material, i.e. a flexible and/or compressible material suitable for dampening vibrations between sound attenuating material 30 and subfloor 20. Rubber, foam rubber and other similar materials may be used as the reactive material on tip 36. One skilled in the art will understand that the reactive material may be any material that reduces the transmission of vibration. Typically, the reactive material will be applied over tip 36 in order to maintain the rigidity of tip 36 and hollow protrusions 34*a*.

The generally flat surfaces 31 between hollow protrusions 34*a* and open recesses 34*b* typically have a thickness of about 0.002 inch to about 0.1 inch. More typically, flat surfaces 31 have a thickness of 0.006 inch. One skilled in the art will understand that the thickness of flat surfaces 31 depends on the tensile strength, elasticity, and flexibility of sound attenuating material 30.

Overlayment 40 overlays second surface 32*b* of sound attenuating material 30. When poured as a slurry over sound attenuating material 30, overlayment 40 flows into open recesses 34*b* of sound attenuating material 30. The combination of overlayment 40 and sound attenuating material 30 allows for a near-direct contact between overlayment 40 and subfloor 20. Only the thickness of sound attenuating material 30 at tips 36 and airgaps 38 separate overlayment 40 from subfloor 20. Typically, the filling of recesses 34*b* ensures that between about 5% and about 35% of overlayment 40 is in near-direct contact with subfloor 20. More typically, about 25% of overlayment 40 is in near-direct contact with subfloor 20. Thus, as used herein, the term near-direct contact refers to the length of hollow protrusions 34*a*. As an added benefit of using sound attenuating material 30, upon application of overlayment 40 to sound attenuating material 30, the resulting cured overlayment 40 has a relatively uniform plane. Overlayment 40 may be a cement material, gypsum, portland, fly ash, or any other material of similar structure upon curing. One skilled in the art will understand overlayment 40 is a flowable grout material, a cement or other similar flooring material, capable of filling hollow protrusions 34*a*.

Formation of overlayment 40 on sound attenuating material 30 preserves the flexural strength of sound attenuating flooring system 10 while minimizing the thickness of overlayment 40. For example, when subfloor 20 is wooden and supported by floor joists, cement overlayment 40 will normally require a thickness from 0.75" to 1.5" to provide the desired flexural strength. However, due to the cooperation of sound attenuating material 30 with overlayment 40, the thickness of overlayment 40 used over a wood subfloor 20 supported by joists can be reduced to a thickness of 0.25 inch or less of cement overlayment 40. Typically, in sound attenuating flooring system 10, overlayment 40 has a thickness of about 0.25 inch to about 0.7 inch.

Typically, sound attenuating flooring system 10 has sufficient vertical rigidity to support between about 10,000 pounds per square foot and about 35,000 pounds per square foot without flexing more than about 0.06 inch. More typically, sound attenuating flooring system 10 has sufficient vertical rigidity to support between about 10,000 pounds per square foot and about 35,000 pounds per square foot without flexing more than about 0.04 inch. For example, in some embodiments, sound attenuating flooring system 10 has sufficient rigidity to support about 33,000 pounds per square foot without flexing more than 0.04 inch. Accordingly, sound attenuating flooring system 10 allows for sound attenuation while also substantially preserving the flexural strength in the integrity of the sound attenuating flooring system 10.

As depicted in FIG. 7, the depth, volume, and number of hollow protrusions 34*a* per square inch provide significant flexural strength to sound attenuating flooring system 10.

The combination of sound attenuating material 30 and overlayment 40 provides sound attenuating flooring system 10 the capability of supporting about 10,000 pounds per square foot to about 35,000 pounds per square foot of pressure. Under these conditions, sound attenuating flooring system 10 will compress or flex, but will not fail. Even with the greatest amount of pressure per square foot, sound attenuating flooring system 10 typically will not compress or flex more than about 0.06 inch. More typically, even under the application of 35,000 pounds per square foot, sound attenuating flooring system 10 will not compress or flex more than about 0.04 inch. For example, in at least one embodiment, as disclosed herein, when 33,000 pounds per square foot of pressure was applied to sound attenuating flooring system 10, the combination of overlayment 40 and sound attenuating material 30 did not compress more than about 0.04 inch. Such higher compression resistance reduces the likelihood of a failure of sound attenuating flooring system 10, i.e. overlayment 40 portion of sound attenuating flooring system 10 is very resistant to cracking. The unexpected result of sound attenuating flooring system 10 derives from the strong, incompressible sound attenuating material 30 which allows overlayment 40 to be poured as a thinner layer in near-direct contact with subfloor 20 while maintaining the flexural strength of sound attenuating flooring system 10. Maintaining flexural strength provides resistance to flex of subfloor 20. Thus, sound attenuation in a flooring system has been achieved without the reduction of flexural strength of the flooring system.

With reference to FIG. 7 and FIG. 8, the compressive strength of sound attenuating material 30 was tested on a lab scale using ASTM D1621. One of ordinary skill in the art will be familiar with the ASTM D1621 standard for testing. Testing was carried out on a dynamometer having a top plate. Compressive strength was measured as the top plate was pressed against a 10 cm×10 cm sample of material. The compressive strength is recorded at 5%, 10%, 20%, 30%, 40%, and 50% of deformation of the initial thickness of the material.

The tests were carried out on three samples of each material. The average result for each material is reported in the tables shown in FIG. 7 and FIG. 8. The table in FIG. 7 provides the results of testing on only the sound attenuating material used. The table in FIG. 8 provides the results of testing on the sound attenuating material after that sound attenuating material has been coated with a layer of gypsum. The materials in FIG. 8 were allowed to cure for two days prior to testing. With reference to FIG. 7 and FIG. 8, each of the sound attenuating materials tests had a different original thickness. Therefore, the mm depression also varied. As a result, the percentage (%) displacement is the value of interest. The percent displacement correlates to the compressive strength of the material. In FIG. 7 and FIG. 8, for sound attenuating material 30, displacement of 20% of total thickness correlates to 1 mm. However, as the original thickness of each sound attenuating material tested differs, displacement of 20% of total thickness may be more or less than 1 mm for the other sound attenuating materials.

Under the testing conditions, a subfloor was omitted. However, the test results provide a clear indication of the compressive strength of the tested materials. The results depicted in the tables of FIG. 7 and FIG. 8 clearly show excellent compressive strength performance of sound attenuating material 30. With reference to the table of FIG. 8, when the top plate of the dynamometer test equipment has been displaced by 1 full millimeter, i.e. equaling displacement of 20% of total thickness, the combination of sound attenuating material 30 with gypsum overlay is capable of supporting 21,000 pounds per square foot.

With reference to FIG. 9, the sound attenuating ability of sound attenuating material 30 was tested on a lab scale using ASTM E492. One of ordinary skill in the art will be familiar with the ASTM E492 standard for testing. ASTM E492 testing determines the Impact Insulation Class ("IIC") rating of a typical construction assembly to determine the contribution that a sound attenuating/deadening material adds to the floor assembly's ability to absorb impact sound. The larger the IIC number, the more impact sound is being blocked.

Testing was carried out with the following configuration (bottom up): a single layer of 0.625 fire rated gypsum board, a metal resilient channel, an 18 inch wood truss joist spaced 24 inch on center, a 4 inch batt fiberglass insulation loose laid in the cavity, 0.75 inch oriented strand board panels as the subfloor, then either no sound attenuating material, sound attenuating material 30, or sound attenuating material with a 3 mm fibrous mat between sound attenuating material 30 and the subfloor, a gypsum layer, and the finished floor covering. Under the testing conditions, the results in the table of FIG. 9 clearly show excellent sound attenuation properties of sound attenuating material 30.

For example, as shown in the table of FIG. 9, when no sound attenuating material was used, and the finished floor covering was vinyl, the IIC rating was 44. Under those same conditions, but with sound attenuating material 30 used, the IIC rating was 51. In addition, under those same conditions, with the combination of sound attenuating material 30 and a 3 mm fibrous mat, the IIC rating was 55. Such test results clearly show the sound attenuation ability of sound attenuating material 30.

Figure 5:
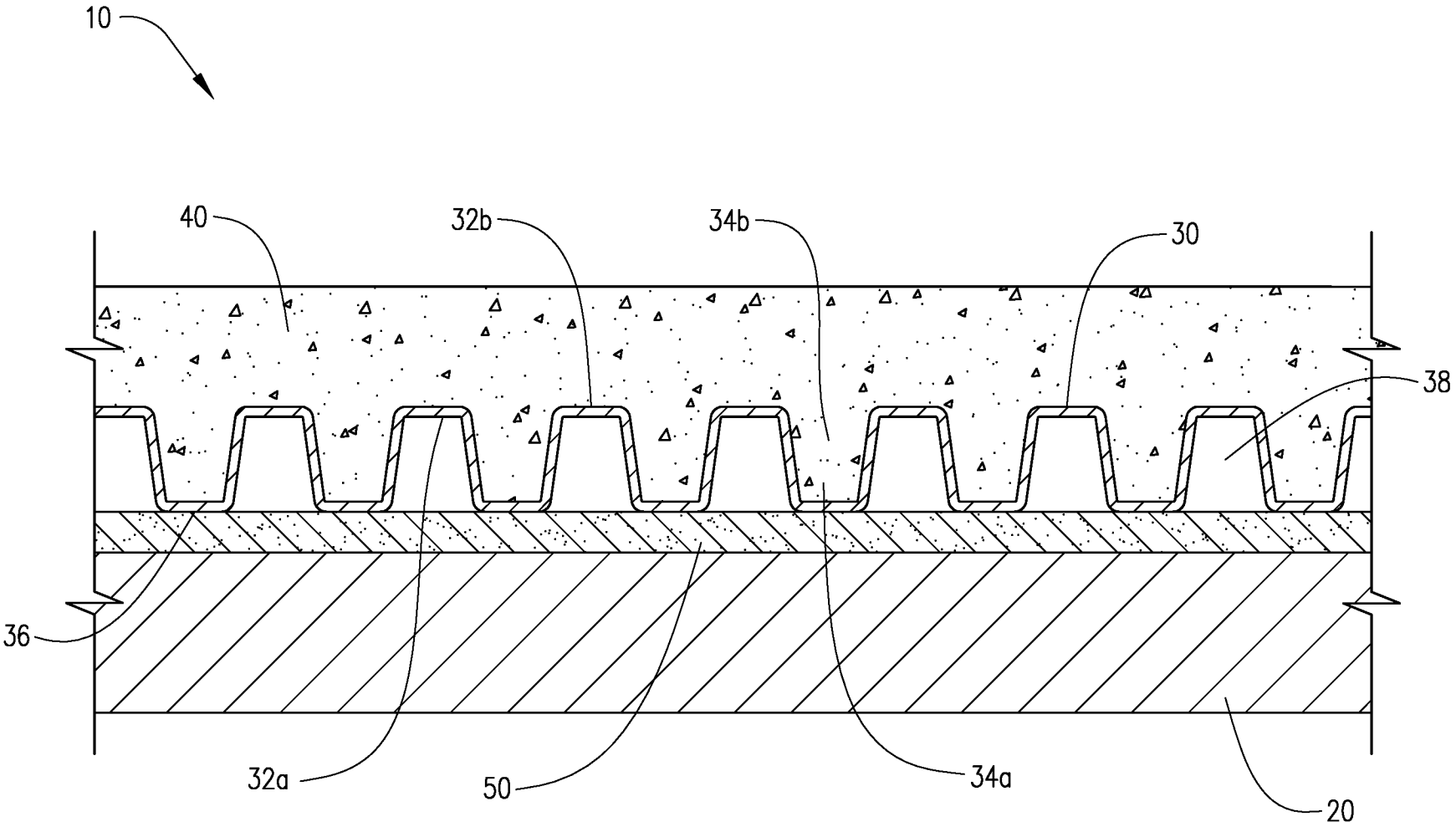
FIG. 5 is a cross-sectional side view of a sound attenuating flooring system with an underlayment in accordance with one embodiment of the present disclosure.
Figure 3:
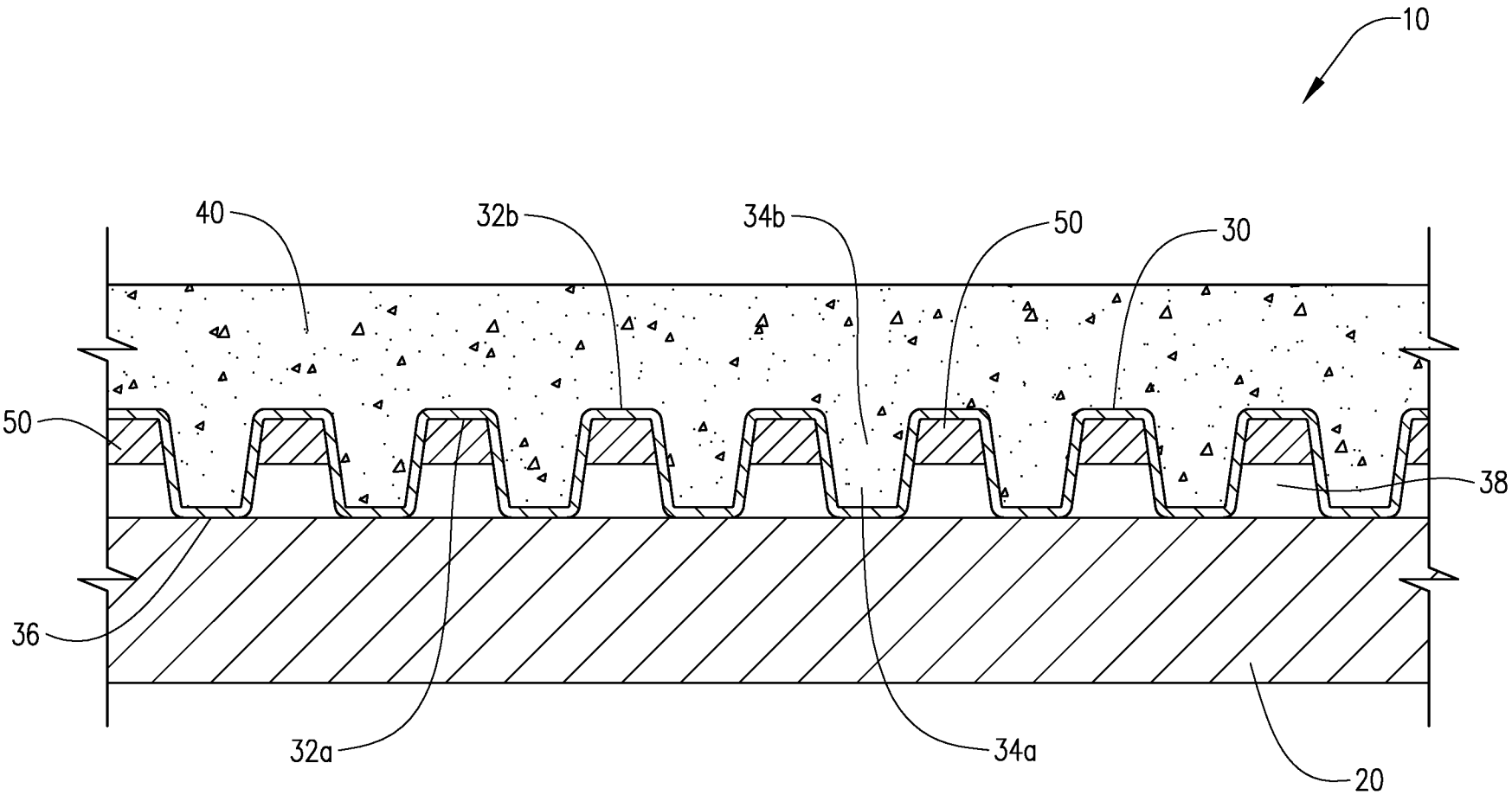

Sound attenuating flooring system 10 may optionally include an underlayment 50. Underlayment 50 further improves the sound attenuation ability of sound attenuating flooring system 10 by providing an additional sound attenuating barrier. As depicted in FIG. 1 and FIG. 5, when used, underlayment 50 will be located between subfloor 20 and sound attenuating material 30. Optionally, as shown by FIG. 6, underlayment 50 includes a plurality of holes corresponding to hollow protrusions 34*a*. The plurality of holes hollow protrusions 34*a* to pass through underlayment 50 and contact subfloor 20. In such embodiments, underlayment 50 may partially fill, as shown in FIG. 6, or completely fill air gaps 38. In some embodiments, underlayment 50 is a fibrous material, a rubber material, or a non-woven material such as a resilient polymer material. As a further option, underlayment 50 may be adhered to first surface 32*a*.

Assembly of sound attenuating flooring system 10 includes the steps of: installing subfloor 20; placing sound attenuating material 30 on subfloor 20 such that tips 36 of hollow protrusions 34*a* contact subfloor 20; and pouring overlayment 40 on sound attenuating material 30. The application of the overlayment 40 should be at a rate such that overlayment 40 flows into and substantially fills all open recesses 34*b* of sound attenuating material 30. Optionally, during assembly of sound attenuating flooring system 10, underlayment 50 will either be adhered to sound attenuating material 30 or placed on subfloor 20 prior to placement of sound attenuating material 30 on subfloor 20.

As depicted in FIGS. 1 and 4, tips 36 of hollow protrusions 34*a* contact subfloor 20 and define air gaps 38. Without being bound by theory, combination of air gaps 38 and the near-direct contact of overlayment 40 with subfloor 20 is believed to provide improved sound attenuation and increased flexural strength when compared to prior art systems. When used, underlayment 50 further improves the sound attenuation of sound attenuating flooring system 10. Thus, sound attenuating material 30 provides both enhanced flexural strength and cooperates with subfloor 20 to form air gaps 38 to provide sound attenuation. As a result, when a person walks over the finished floor, the impact of each step is attenuated by the air trapped within air gaps 38 thereby reducing the transmission of sound through the finished floor to a residence below.

As a further benefit, use of sound attenuating material 30 with hollow protrusions 34*a* reduces the volume of overlayment 40 necessary for sound attenuating flooring system 10 while maintaining the structural rigidity of sound attenuating flooring system 10. Typically, the thickness of overlayment 40 is about 0.25 inch to about 0.7 inch. In general, the reduced volume of overlayment 40 will correspond to the volume displaced by airgaps 38. Thus, use of sound attenuating material 30 provides sound attenuation without detrimentally impacting the flexural strength of sound attenuating flooring system 10. Accordingly, the sound attenuating flooring system 10 does not require an increased volume of overlayment 40 when using sound attenuating material 30. The vertical flexural strength of the combination of subfloor 20, sound attenuating material 30, and overlayment 40 provide the ability to maintain structural rigidity without increasing the volume or thickness of overlayment 40.

Hollow protrusions 34*a* in sound attenuating material 30 also offer an advantage in installation over prior sound attenuating materials. Adjacent sections of sound attenuating material 30 may overlap such that hollow protrusions 34*a* of one section nest in recesses 34*b* of an adjacent section. Preferably, the nesting of hollow protrusions 34*a* in recesses 34*b* provides a snap for confirmation that hollow protrusions 34*a* are nested in recesses 34*b*.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A sound attenuating flooring system comprising:

a subfloor;

a sound attenuating material overlaying the subfloor, the sound attenuating material having a first surface and a second surface, the first surface defined by a plurality of outwardly projecting hollow protrusions, each protrusion has a tip, the tip carries a vibration dampening reactive material, said vibration dampening reactive material on the tip of the outwardly projecting hollow protrusions in direct contact with said subfloor, and the second surface defined by a plurality of open recesses corresponding to the plurality of outwardly projecting hollow protrusions; and an overlayment overlaying the second surface of the sound attenuating material.

2. The sound attenuating flooring system of claim 1, wherein the sound attenuating material includes between 4 outwardly projecting hollow protrusions to 50 outwardly projecting hollow protrusions per square inch.

3. The sound attenuating flooring system of claim 1, characterized by the plurality of outwardly projecting hollow protrusions extending outward from the first surface of the sound attenuating material by about 0.125 inch to about 0.75 inch and further characterized by the sound attenuating flooring system supporting between about 10,000 pounds per square foot and about 35,000 pounds per square foot without flexing more than about 0.06 inch.

4. The sound attenuating flooring system of claim 1, characterized by the plurality of outwardly projecting hollow protrusions extending outward from the first surface of the sound attenuating material by about 0.125 inch to about 0.75 inch and further characterized by the sound attenuating flooring system supporting about 33,000 pounds per square foot without flexing more than about 0.06 inch.

5. The sound attenuating flooring system of claim 1, characterized by the plurality of outwardly projecting hollow protrusions extending outward from the first surface of the sound attenuating material by about 0.125 inch to about 0.75 inch and further characterized by the sound attenuating flooring system supporting between about 10,000 pounds per square foot and about 35,000 pounds per square foot without flexing more than about 0.04 inch.

6. The sound attenuating flooring system of claim 1, characterized by the plurality of outwardly projecting hollow protrusions extending outward from the first surface of the sound attenuating material by about 0.125 inch to about 0.75 inch and further characterized by the sound attenuating flooring system supporting about 33,000 pounds per square foot without flexing more than about 0.04 inch.

7. The sound attenuating flooring system of claim 1, further comprising an underlayment located between the subfloor and the sound attenuating material wherein the underlayment has a plurality of holes corresponding to the plurality of outwardly projecting hollow protrusions such that, when the underlayment is located between the subfloor and the sound attenuating material, the plurality of outwardly projecting hollow protrusions pass through the underlayment and contact the subfloor.

8. The sound attenuating flooring system of claim 1, wherein the plurality of outwardly protruding hollow protrusions cover about 5% to about 35% of the subfloor covered by the sound attenuating material.

9. The sound attenuating flooring system of claim 1, wherein the sound attenuating flooring system is part of an above-ground flooring system and wherein the overlayment is selected from the group consisting of cement material, gypsum, Portland and fly ash.

10. The sound attenuating flooring system of claim 9 wherein the subfloor is selected from the group consisting of plywood, oriented strand board, concrete, or high performance panels.

11. The sound attenuating flooring system of claim 1, wherein the plurality of outwardly projecting protrusions extend from the first surface of the sound attenuating material between 0.125 inch to about 0.5 inch.

12. The sound attenuating flooring system of claim 1, wherein the plurality of outwardly projecting protrusions extend from the first surface of the sound attenuating material between 0.125 inch to about 0.1875 inch.

13. The sound attenuating flooring system of claim 1, wherein the sound attenuating material has generally flat surfaces between said plurality of outwardly projecting hollow protrusions and said plurality of open recesses, said generally flat surfaces having a thickness of about 0.002 inch to about 0.006 inch.

14. A sound attenuating flooring system comprising:

the sound attenuating flooring system incorporated into an above-ground flooring system;

a subfloor;

an underlayment in direct contact with said subfloor;

a sound attenuating material having a first surface and a second surface, the first surface defined by 4 outwardly projecting hollow protrusions to 50 outwardly projecting hollow protrusions per square inch, each protrusion has a tip, the tip carries a vibration dampening reactive material, said vibration dampening reactive material on the tip of the outwardly projecting hollow protrusions directly contacting said underlayment, and the second surface defined by a plurality of open recesses corresponding to said outwardly projecting hollow protrusions; and an overlayment overlaying the second surface of the sound attenuating material, said overlayment having a thickness between about 0.25 inch and about 0.7 inch.

15. The sound attenuating flooring system of claim 14, characterized by the outwardly projecting hollow protrusions extending outward from the first surface of the sound attenuating material by about 0.125 inch to about 0.75 inch and further characterized by the sound attenuating flooring system supporting between about 10,000 pounds per square foot and about 35,000 pounds per square foot without flexing more than about 0.06 inch.

16. The sound attenuating flooring system of claim 14, characterized by the plurality of outwardly projecting hollow protrusions extending outward from the first surface of the sound attenuating material by about 0.125 inch to about 0.75 inch and further characterized by the sound attenuating flooring system supporting about 33,000 pounds per square foot without flexing more than about 0.06 inch.

17. The sound attenuating flooring system of claim 14, characterized by the outwardly projecting hollow protrusions extending outward from the first surface of the sound attenuating material by about 0.125 inch to about 0.75 inch and further characterized by the sound attenuating flooring system supporting between about 10,000 pounds per square foot and about 35,000 pounds per square foot without flexing more than about 0.04 inch.

18. The sound attenuating flooring system of claim 14, wherein the subfloor is selected from the group consisting of plywood, oriented strand board, concrete, or high performance panels.

19. The sound attenuating flooring system of claim 14, wherein said outwardly projecting hollow protrusions cooperate with said underlayment to define air gaps and said underlayment at least partially fills said air gaps.

20. The sound attenuating flooring system of claim 19, wherein the underlayment has a plurality of holes corresponding to the outwardly projecting hollow protrusions such that, when the underlayment is located between the subfloor and the sound attenuating material, the outwardly projecting hollow protrusions pass through the underlayment and contact the subfloor.

21. The sound attenuating flooring system of claim 14, wherein the hollow protrusions cover about 5% to about 35% of the subfloor covered by the sound attenuating material.

22. The sound attenuating flooring system of claim 14, wherein the plurality of outwardly projecting protrusions extend from the first surface of the sound attenuating material between 0.125 inch to about 0.75 inch.

23. The sound attenuating flooring system of claim 14, wherein the outwardly projecting protrusions extend from the first surface of the sound attenuating material between 0.125 inch to about 0.5 inch.

24. The sound attenuating flooring system of claim 14, wherein the plurality of outwardly projecting protrusions extend from the first surface of the sound attenuating material between 0.125 inch to about 0.375 inch.

25. The sound attenuating flooring system of claim 14, wherein the plurality of outwardly projecting protrusions extend from the first surface of the sound attenuating material between 0.125 inch to about 0.1875 inch.

26. The sound attenuating flooring system of claim 14, wherein the sound attenuating material has generally flat surfaces between said plurality of outwardly projecting hollow protrusions and said plurality of open recesses, said generally flat surfaces having a thickness of about 0.002 inch to about 0.006 inch.

* * * * *